US009408260B2

(12) United States Patent
Zhang

(10) Patent No.: US 9,408,260 B2
(45) Date of Patent: Aug. 2, 2016

(54) ANALOG DIMMING CONVERSION CIRCUIT AND DISPLAY DEVICE

(71) Applicant: SHENZHEN CHINA STAR OPTOELECTRONICS TECHNOLOGY CO., LTD., Shenzhen (CN)

(72) Inventor: Xianming Zhang, Shenzhen (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 14/417,630

(22) PCT Filed: Oct. 31, 2014

(86) PCT No.: PCT/CN2014/090036

§ 371 (c)(1),
(2) Date: Jan. 27, 2015

(65) Prior Publication Data

US 2016/0113075 A1 Apr. 21, 2016

(30) Foreign Application Priority Data

Oct. 20, 2014 (CN) ..... 2014 1 0559611.X

(51) Int. Cl.
*H05B 37/02* (2006.01)
*H05B 39/04* (2006.01)
*H05B 33/08* (2006.01)

(52) U.S. Cl.
CPC ..... *H05B 33/0812* (2013.01); *H05B 33/0845* (2013.01)

(58) Field of Classification Search
CPC ..... H05B 39/044; H05B 37/02
USPC ..... 315/311, 224, 307, 297
See application file for complete search history.

(56) References Cited

U.S. PATENT DOCUMENTS 3,563,642 A * 2/1971 Rak ..... G03B 21/10 352/104
4,009,387 A * 2/1977 Nuver ..... H05B 41/3922 250/205
2006/0001381 A1 1/2006 Robinson et al.
2013/0106298 A1 5/2013 Datta et al.

FOREIGN PATENT DOCUMENTS

CN 101010649 A 8/2007
CN 202340329 U 7/2012

(Continued)

OTHER PUBLICATIONS

International Search Report (Forms PCT/ISA/220 and PCT/ISA/210) and the Written Opinion (Form PCT/ISA/237) Issued on Jul. 10, 2015, by the State Intellectual Property Office of China acting as the International Searching Authority in corresponding International Application No. PCT/CN2014/090036. (11 pages).

*Primary Examiner* — Daniel D Chang
(74) *Attorney, Agent, or Firm* — Buchanan Ingersoll & Rooney PC

(57) ABSTRACT

An analog dimming conversion circuit includes a first voltage dividing unit, a second voltage dividing unit, and a constant voltage unit. An input end of the first voltage dividing unit receives an analog dimming input signal. An output end of the first voltage dividing unit outputs a first intermediate voltage. An output end of the constant voltage unit outputs a second intermediate voltage which is constant. A first input end and a second input end of the second voltage dividing unit receive the first intermediate voltage and the second intermediate voltage respectively. An output end of the second voltage dividing unit outputs an analog dimming output signal. The analog dimming conversion circuit of the present disclosure can be used in liquid crystal TV, liquid crystal display, mobile phone, tablet personal computer, and other display devices with analog dimming function.

5 Claims, 1 Drawing Sheet

(56) References Cited

FOREIGN PATENT DOCUMENTS

| | | | |
|---|---|---|---|
| CN | 202434187 | U | 9/2012 |
| CN | 102870497 | A | 1/2013 |
| CN | 202949594 | U | 5/2013 |
| KR | 10-2011-0049519 | A | 5/2011 |

* cited by examiner

ANALOG DIMMING CONVERSION CIRCUIT AND DISPLAY DEVICE

CROSS REFERENCE TO RELATED APPLICATION

The present application claims benefit of Chinese patent application CN 201410559611.X, entitled "Analog Dimming Conversion Circuit and Display Device" and filed on Oct. 20, 2014, which is incorporated herein by reference.

FIELD OF THE INVENTION

The present disclosure relates to the technical field of display, and particularly to an analog dimming conversion circuit and a display device.

BACKGROUND OF THE INVENTION

With the development of display technology, liquid crystal display has become the most commonly used display device. Currently, more and more Light-Emitting Diodes (LED) are used in the liquid crystal display as the backlight source. Moreover, it is hoped that the brightness of the LED can be changed according to different application circumstances. Therefore, the driver of the LED should have the function of brightness adjustment.

Compared with traditional PWM Dimming technology, the Analog Dimming (ADIM) technology has many advantages, such as no noise. However, the voltage range of the dimming signal that is supported by the current analog dimming technology is relatively narrow. In general, the linear dimming can only be performed when the voltage of the dimming signal ranges from 0.5 V to 2.5 V, while the analog dimming cannot be performed when the voltage of the dimming signal ranges from 0 V to 0.5 V or is higher than 2.5 V. however, during display procedures, the voltage of the dimming signal generally ranges from 0 V to 3.3 V. Therefore, the dimming capability of the current analog dimming technology is poor owing to its narrow dimming range.

SUMMARY OF THE INVENTION

The purpose of the present disclosure is to provide an analog dimming conversion circuit and a display device, so as to solve the technical problem of poor dimming capability in the current analog dimming technology.

The present disclosure provides an analog dimming conversion circuit, comprising a first voltage dividing unit, a second voltage dividing unit, and a constant voltage unit, wherein an input end of said first voltage dividing unit receives an analog dimming input signal, and an output end of said first voltage dividing unit outputs a first intermediate voltage; wherein an output end of said constant voltage unit outputs a second intermediate voltage which is constant; and wherein a first input end and a second input end of said second voltage dividing unit receive said first intermediate voltage and said second intermediate voltage respectively, and an output end of said second voltage dividing unit outputs an analog dimming output signal.

Further, the output end of said second voltage dividing unit is connected with a diode, and a 2D/3D conversion signal is connected with the output end of said second voltage dividing unit through said diode.

Further, the output end of said first voltage dividing unit and/or the output end of said constant voltage unit is provided with a voltage follower.

Preferably, said first voltage dividing unit comprises a first resistor and a second resistor in series connection between the input end thereof and a ground wire, and the output end of said first voltage dividing unit is provided between said first resistor and said second resistor. Preferably, a value of said first resistor is 114 kΩ, a value of said second resistor is 200 kΩ, and a voltage of said analog dimming input signal ranges from 0 V to 3.3 V.

Preferably, said constant voltage unit comprises a reference voltage source, and a third resistor and a fourth resistor in series connection between said reference voltage source and said ground wire, and the output end of said constant voltage unit is provided between said third resistor and said fourth resistor. Preferably, a value of said third resistor is 182 kΩ and a value of said fourth resistor is 20 kΩ.

Preferably, said second voltage dividing unit comprises a fifth resistor and a sixth resistor in series connection between the first input end and the second input end thereof, and the output end of said second voltage dividing unit is provided between the fifth resistor and the sixth resistor. Preferably, a value of said fifth resistor is 83 kΩ and a value of said sixth resistor is 15 kΩ.

The present disclosure further provides a display device, comprising an analog dimming circuit and said analog dimming conversion circuit, which outputs an analog dimming output signal to said analog dimming circuit.

The following beneficial effects can be brought about by the present disclosure. In the analog dimming conversion circuit provided by the present disclosure, the analog dimming input signal with a relatively large voltage range can be converted into the first intermediate voltage with a relatively small voltage range through the first voltage dividing unit, and the constant voltage unit outputs the second intermediate voltage which is constant. The second voltage dividing unit performs voltage dividing on the first intermediate voltage and the second intermediate voltage, and the voltage of the analog dimming output signal output by the second voltage dividing unit is between the first intermediate voltage and the second intermediate voltage. In this manner, the voltage of the analog dimming output signal falls within the effective dimming range of the analog dimming, which generally ranges from 0.5 V to 2.5 V. Therefore, the analog dimming input signal with a relatively large voltage range can be converted into the analog dimming output signal with a relatively small voltage range by the analog dimming conversion circuit provided by the present disclosure, whereby the dimming range of the analog dimming can be expanded, and the dimming capability thereof can be improved.

Other features and advantages of the present disclosure will be further explained in the following description, and partially become self-evident therefrom, or be understood through the embodiments of the present disclosure. The objectives and advantages of the present disclosure will be achieved through the structure specifically pointed out in the description, claims, and the accompanying drawings.

BRIEF DESCRIPTION OF THE DRAWINGS

The drawings necessary for explaining the embodiments are introduced briefly below to illustrate the technical solutions of the embodiments of the present disclosure more clearly.

DETAILED DESCRIPTION OF THE EMBODIMENTS

The present disclosure will be explained in details with reference to the embodiments and the accompanying drawings, whereby it can be fully understood how to solve the technical problem by the technical means according to the present disclosure and achieve the technical effects thereof, and thus the technical solution according to the present disclosure can be implemented. It should be noted that, as long as there is no structural conflict, all the technical features mentioned in all the embodiments may be combined together in any manner, and the technical solutions obtained in this manner all fall within the scope of the present disclosure.

The embodiment of the present disclosure provides an analog dimming conversion circuit, so as to expand the dimming range of the analog dimming of the display device.

Figure 1:
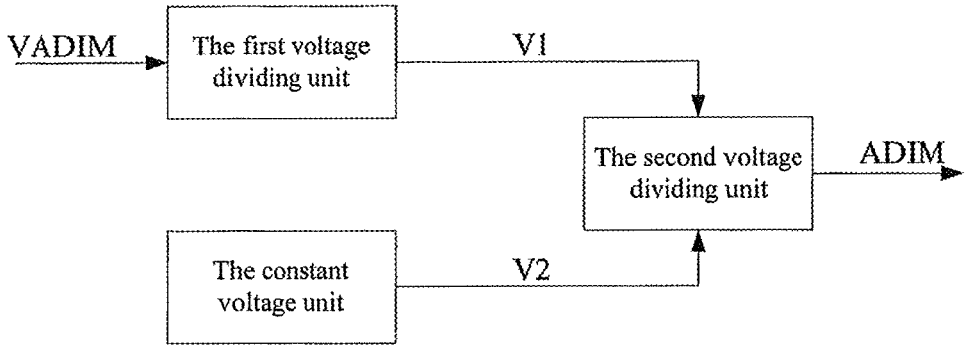
FIG. 1 is a schematic diagram of an analog dimming conversion circuit according to an embodiment of the present disclosure.

As shown in FIG. 1, the analog dimming conversion circuit comprises a first voltage dividing unit, a second voltage dividing unit, and a constant voltage unit.

An input end of the first voltage dividing unit receives an analog dimming input signal VADIM. The analog dimming input signal VADIM with a relatively large voltage range is converted into a first intermediate voltage V1 with a relatively small voltage range, and then output to the second voltage dividing unit from an output end of the first voltage dividing unit. A second intermediate voltage V2, which is constant and generated by the constant voltage unit, is output to the second voltage dividing unit from an output end of the constant voltage unit.

A first input end and a second input end of the second voltage dividing unit receive V1 and V2 respectively. The second voltage dividing unit performs voltage dividing on V1 and V2, whereby an analog dimming output signal ADIM is generated, and then output from an output end of the second voltage dividing unit. The voltage of the analog dimming output signal ADIM is between V1 and V2, so that the voltage of the analog dimming output signal ADIM falls within the effective dimming range of the analog dimming, which generally ranges from 0.5 V to 2.5 V.

Therefore, the analog dimming input signal VADIM with a relatively large voltage range can be converted into the analog dimming output signal ADIM with a relatively small voltage range by the analog dimming conversion circuit provided by the embodiment of the present disclosure, whereby the dimming range of the analog dimming can be expanded, and the dimming capability thereof can be improved.

Figure 2:
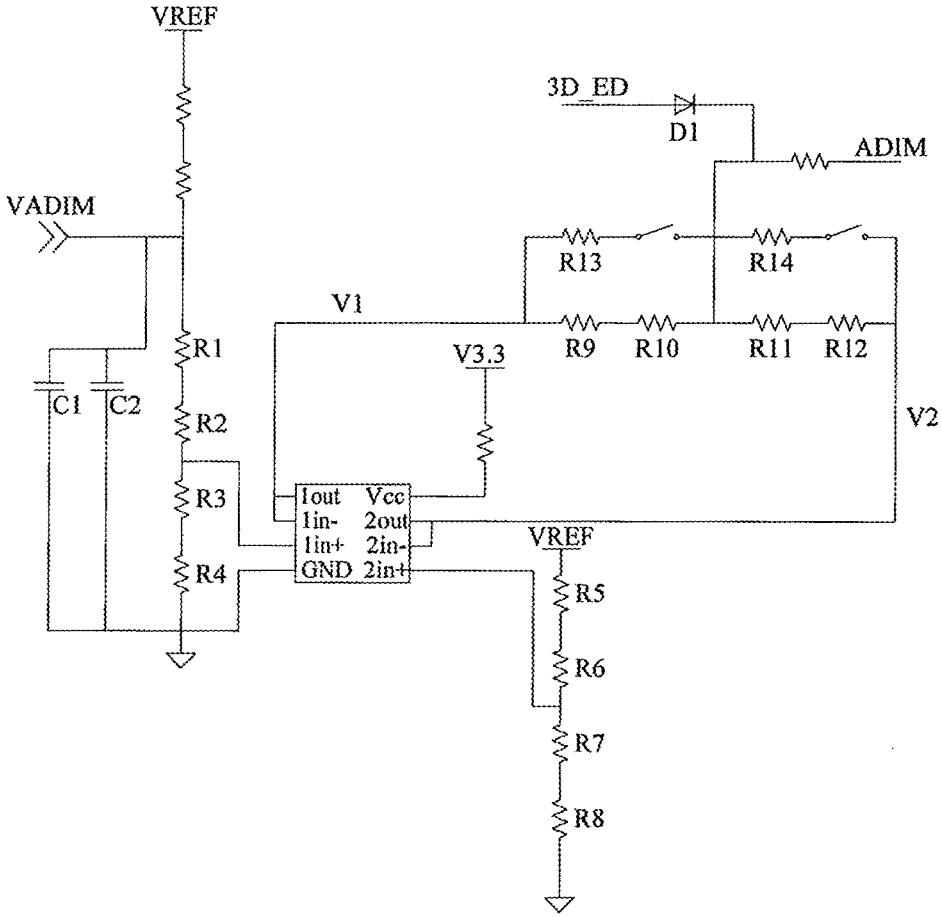
FIG. 2 is a circuit diagram of the analog dimming conversion circuit according to the embodiment of the present disclosure.

A preferred embodiment of the analog dimming conversion circuit provided by the present disclosure is shown in FIG. 2, and the embodiment is applicable to a circuit with 2D/3D conversion function. The output end of the second voltage dividing unit is connected with a diode D1, and a 2D/3D conversion signal 3D_ED is connected with the output end of the second voltage dividing unit through D1. The 3D_ED is a low-level signal during 2D display mode; and the 3D_ED is a high-level signal during 3D display mode, and the voltage thereof is generally 3.3 V.

As shown in FIG. 2, the first voltage dividing unit comprises a first resistor and a second resistor in series connection between the input end thereof and a ground wire, and the output end of the first voltage dividing unit is provided between the first resistor and the second resistor. In the present embodiment, the first resistor consists of R1 and R2 in series connection with each other. The value of R1 is 52 kΩ, the value of R2 is 62 kΩ, and thus the total value of the first resistor is 114 kΩ. Similarly, the second resistor consists of R3 and R4 in series connection with each other. The values of R3 and R4 are both 100 kΩ, and thus the total value of the second resistor is 200 kΩ. In addition, a reference voltage source VREF is arranged on the first voltage dividing unit, and the first resistor and the second resistor are in parallel connection with filter capacitors C1 and C2.

During 2D display mode, the analog dimming input signal VADIM input into the first voltage dividing unit ranges from 0 V to 3.3 V. Based on the values of the first resistor and the second resistor, it can be obtained through calculation that the first intermediate voltage V1 output by the first voltage dividing unit is about 0.64 times of the analog dimming input signal VADIM. That is, the first intermediate voltage V1 ranges from 0 V to 2.1 V.

The constant voltage unit comprises a reference voltage source VREF, and a third resistor and a fourth resistor in series connection between the reference voltage source VREF and the ground wire. The output end of the constant voltage unit is provided between the third resistor and the fourth resistor. In the present embodiment, the third resistor consists of R5 and R6 in series connection with each other. The values of R5 and R6 are both 91 kΩ, and thus the total value of the third resistor is 182 kΩ. Similarly, the fourth resistor consists of R7 and R8 in series connection with each other. The values of R7 and R8 are both 10 kΩ, and thus the total value of the fourth resistor is 20 kΩ.

The voltage of the reference voltage source VREF is 5.95 V. Based on the values of the third resistor and the fourth resistor, it can be obtained through calculation that the second intermediate voltage V2 output by the constant voltage unit is about 0.1 times of the voltage of the reference voltage source VREF. That is, the second intermediate voltage V2 is 0.6 V.

Further, the output end of the first voltage dividing unit and/or the output end of the constant voltage unit can be provided with a voltage follower. In the present embodiment, two voltage followers are provided by a LM358DR, and connected with the output end of the first voltage dividing unit and the output end of the constant voltage unit respectively, so as to separate the first voltage dividing unit from the constant voltage unit.

The second voltage dividing unit comprises a fifth resistor and a sixth resistor in series connection between the first input end and the second input end thereof, and the output end of the second voltage dividing unit is provided between the fifth resistor and the sixth resistor. In the present embodiment, the fifth resistor consists of R9 and R10 in series connection with each other. The value of R9 is 41 kΩ, the value of R10 is 42 kΩ, and thus the total value of the fifth resistor is 83 kΩ. Similarly, the sixth resistor consists of R11 and R12 in series connection with each other. The value of R11 is 7 kΩ, the value of R12 is 8 kΩ, and thus the total value of the sixth resistor is 15 kΩ. In addition, a resistor R13, which is in parallel connection with R9 and R10, and a resistor R14, which is in parallel connection with R11 and R12, can be provided. The values of R13 and R14 are both 1 MΩ. Whether R13 is in parallel connection with R9 and R10, and whether R14 is in parallel connection with R11 and R12 can both be selected through a corresponding switch provided therein. In this manner, the values of the fifth resistor and the sixth resistor can be regulated slightly, and thus the analog dimming output signal ADIM output by the second voltage dividing unit can be adjusted.

Based on the values of the fifth resistor and the sixth resistor, it can be obtained through calculation that the analog dimming output signal ADIM output by the second voltage dividing unit ranges from 0.504 V to 0.840 V.

The values of the analog dimming input signal VADIM, the first intermediate voltage V1, the second intermediate voltage V2, and the analog dimming output signal ADIM are shown in Table 1.

TABLE 1

| VADIM (V) | V1 (V) | V2 (V) | ADIM (V) |
|---|---|---|---|
| 0 | 0 | 0.6 | 0.504 |
| 1 | 0.636 | 0.6 | 0.606 |
| 2 | 1.273 | 0.6 | 0.708 |
| 3.3 | 2.1 | 0.6 | 0.840 |

According to the analog dimming conversion circuit provided by the embodiment of the present disclosure, the analog dimming input signal VADIM with a voltage range of 0 V to 3.3 V can be converted into the analog dimming output signal ADIM with a voltage range of 0.504 V to 0.840 V during 2D display mode, so that the voltage range of the analog dimming output signal ADIM falls within the effective dimming range of the analog dimming. In this case, the effective dimming range of the analog dimming can be expanded to 0 V to 3.3 V, and the dimming capability thereof can be improved.

In other embodiments, the value of each resistor in the first voltage dividing unit, the second voltage dividing unit, and the constant voltage unit can be regulated, so that a more appropriate voltage range of the analog dimming output signal ADIM can be obtained to adapt to different analog dimming situations and obtain different analog dimming accuracies.

During 3D display mode, the 2D/3D conversion signal 3D_ED is a high-level signal with a voltage of 3.3 V. The 3D_ED is output directly as the analog dimming output signal ADIM through D1, wherein D1 can be selected as a diode with a voltage drop of about 0.4 V. In this manner, the voltage of the analog dimming output signal ADIM is about 2.9 V.

The embodiment of the present disclosure further provides a display device, comprising an analog dimming circuit and the analog dimming conversion circuit provided by the above embodiment. The analog dimming conversion circuit receives the analog dimming input signal VADIM and converts said VADIM into the analog dimming output signal ADIM, which is output to the analog dimming circuit. Then, the analog dimming circuit performs analog dimming on the backlight of the display device according to the analog dimming output signal ADIM.

Since the display device provided by the embodiment of the present disclosure comprises the same technical features as the analog dimming conversion circuit provided by the above embodiment, it can solve the same technical problem and achieve the same technical effect.

The above embodiments are described only for better understanding, rather than restricting, the present disclosure. Any person skilled in the art can make amendments to the implementing forms or details without departing from the spirit and scope of the present disclosure. The protection scope of the present disclosure shall be determined by the scope as defined in the claims.

The invention claimed is:

1. An analog dimming conversion circuit comprising a first voltage dividing unit, a second voltage dividing unit, and a constant voltage unit, wherein an input end of said first voltage dividing unit receives an analog dimming input signal, and an output end of said first voltage dividing unit outputs a first intermediate voltage;

wherein an output end of said constant voltage unit outputs a second intermediate voltage which is constant;

wherein a first input end and a second input end of said second voltage dividing unit receive said first intermediate voltage and said second intermediate voltage respectively, and an output end of said second voltage dividing unit outputs an analog dimming output signal; and wherein the output end of said first voltage dividing unit and/or the output end of said constant voltage unit is provided with a voltage follower.

2. An analog dimming conversion circuit comprising a first voltage dividing unit, a second voltage dividing unit, and a constant voltage unit, wherein an input end of said first voltage dividing unit receives an analog dimming input signal, and an output end of said first voltage dividing unit outputs a first intermediate voltage;

wherein an output end of said constant voltage unit outputs a second intermediate voltage which is constant;

wherein a first input end and a second input end of said second voltage dividing unit receive said first intermediate voltage and said second intermediate voltage respectively, and an output end of said second voltage dividing unit outputs an analog dimming output signal, wherein said first voltage dividing unit comprises a first resistor and a second resistor in series connection between the input end thereof and a ground wire, and the output end of said first voltage dividing unit is provided between said first resistor and said second resistor, and wherein a value of said first resistor is 114 kΩ, a value of said second resistor is 200 kΩ, and a voltage of said analog dimming input signal ranges from 0 V to 3.3 V.

3. An analog dimming conversion circuit comprising a first voltage dividing unit, a second voltage dividing unit, and a constant voltage unit, wherein an input end of said first voltage dividing unit receives an analog dimming input signal, and an output end of said first voltage dividing unit outputs a first intermediate voltage;

wherein an output end of said constant voltage unit outputs a second intermediate voltage which is constant;

wherein a first input end and a second input end of said second voltage dividing unit receive said first intermediate voltage and said second intermediate voltage respectively, and an output end of said second voltage dividing unit outputs an analog dimming output signal, wherein said constant voltage unit comprises a reference voltage source, and a third resistor and a fourth resistor in series connection between said reference voltage source and said ground wire, and the output end of said constant voltage unit is provided between said thid resistor and said fourth resistor, and wherein a value of said third resistor is 182 kΩ, and a value of said fourth resistor is 20 kΩ.

4. An analog dimming conversion circuit comprising a first voltage dividing unit, a second voltage dividing unit, and a constant voltage unit, wherein an input end of said first voltage dividing unit receives an analog dimming input signal, and an output end of said first voltage dividing unit outputs a first intermediate voltage;

wherein an output end of said constant voltage unit outputs a second intermediate voltage which is constant;

wherein a first input end and a second input end of said second voltage dividing unit receive said first intermediate voltage and said second intermediate voltage respectively, and an output end of said second voltage dividing unit outputs an analog dimming output signal, and wherein said second voltage dividing unit comprises a fifth resistor and a sixth resistor in series connection between the first input end and the second input end thereof, and the output end of said second voltage dividing unit is provided between the fifth resistor and the sixth resistor.

5. The analog dimming conversion circuit according to claim 4, wherein a value of said fifth resistor is 83 kΩ, and a value of said sixth resistor is 15 kΩ.

* * * * *